US005547076A

United States Patent [19]

Doi et al.

[11] Patent Number: 5,547,076

[45] Date of Patent: Aug. 20, 1996

[54] PACKAGING STRUCTURE

[75] Inventors: Yuji Doi, Akishima; Yoshiya Kato, Higashimurayama; Takanobu Kanezashi, Hamura; Yuichi Masuda, Kunitachi, all of Japan

[73] Assignee: Casio Computer Co., Ltd., Tokyo, Japan

[21] Appl. No.: 350,540

[22] Filed: Dec. 7, 1994

[30] Foreign Application Priority Data

Dec. 16, 1993 [JP] Japan ..... 5-342708

[51] Int. Cl.[6] ..... B65D 85/40

[52] U.S. Cl. ..... 206/301; 206/493

[58] Field of Search ..... 206/6.1, 301, 493, 206/495

[56] References Cited

U.S. PATENT DOCUMENTS

| | | | |
|---|---|---|---|
| 1,106,688 | 8/1914 | Tolman | 206/493 X |
| 1,966,662 | 7/1934 | Downs et al. | 206/301 X |
| 2,043,070 | 6/1936 | Rutkowski | 206/493 X |
| 2,122,289 | 6/1938 | Legendre | 206/493 X |
| 3,371,772 | 3/1967 | Fontannaz . | |
| 3,918,577 | 11/1975 | Horzick . | |
| 4,312,449 | 1/1982 | Kinderman | 206/493 X |
| 5,020,660 | 6/1991 | Akerley et al. | 206/411 X |

FOREIGN PATENT DOCUMENTS 1135339 12/1968 United Kingdom .

*Primary Examiner*—Jacob K. Ackun

*Attorney, Agent, or Firm*—Holtz, Goodman, Langer & Chick Frishauf

[57] ABSTRACT

In a packaging structure, a tongue-like portion is formed in one end portion of a base to extend toward an end of the one end portion. A wristwatch, having a pair of watchbands with a band keeper being provided on one of the bands, is placed on the base, and the tongue-like portion is inserted into an opening of the band keeper through a gap of the band keeper and the corresponding watchband. A pillow portion is formed in the one end portion of the base at a region which is nearer to the end of the one end portion than the tongue-like portion. The pillow portion covers the tongue-like portion, and an extending end of the one of the watchbands lays on the pillow portion in a longitudinal direction of the base.

14 Claims, 8 Drawing Sheets

PACKAGING STRUCTURE

BACKGROUND OF THE INVENTION

1. Field of the Invention

The present invention relates to a packaging structure for preventing an article which is placed on a base from being displaced from the base.

2. Description of the Related Art

FIG. 11 shows a conventional packaging structure for packaging a wristwatch. In FIG. 11, the packaging structure is constructed by arranging a wristwatch 4 with a pair of wristbands in a recess 3 formed in an upper surface 2 of a base 1 made of a paper tray and an unexpanded plastic tray or an expanded polystyrene block, and by inserting the base 1 into a clear case 5 a front portion of which faces the wristwatch 4 is transparent.

According to the above-mentioned packaging structure, the wristwatch can be protected by the base 1 during transportation and can be displayed by hanging an upper end portion of the clear case on a peg-like hook member in a display corner.

In the conventional packaging structure, the recess 3 of the base 1 must be formed to correspond to a shape and size of the wristwatch 4 with a pair of wristbands. Therefore, many types of bases 1 having recesses 3 of different shapes and sizes must be prepared. This leads to a rise in a cost of packaging. Further, since the wristwatch 4 is only set in the recess 3 of the base 1, the wristwatch 4 is displaced out of the recess 3 when great vibration is applied to the packaging structure during transportation. This can result in damage to the outer appearance of packaged articles when such packaging structures are displayed.

SUMMARY OF THE INVENTION

This invention is derived from the above described circumstances, and an object of the present invention is to provide a packaging structure which can be used commonly for different kinds of articles of various shapes and sizes, prevent an article placed on a base from displacing out of a predetermined position on the base, lowers a cost of packaging and can maintain a good outer appearance.

In order to achieve the above-mentioned object, the packing structure of the present invention is so made that a tongue-like portion is formed in one end portion of a base so as to extend toward an extending end of the one end portion, the base having an upper surface on which an article having a circular portion is placed, and the tongue-like portion is inserted into an opening of the circular member of the article to hook the article on the base.

According to the above described packaging structure of the present invention, the tongue-like portion of the base is inserted into the opening of the circular portion of the article and hook the article on the base whereby a common base can be used for articles of different shapes and sizes and prevent the article placed on the base from displaying out of the predetermined position on the base.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

First Embodiment

Figure 1:
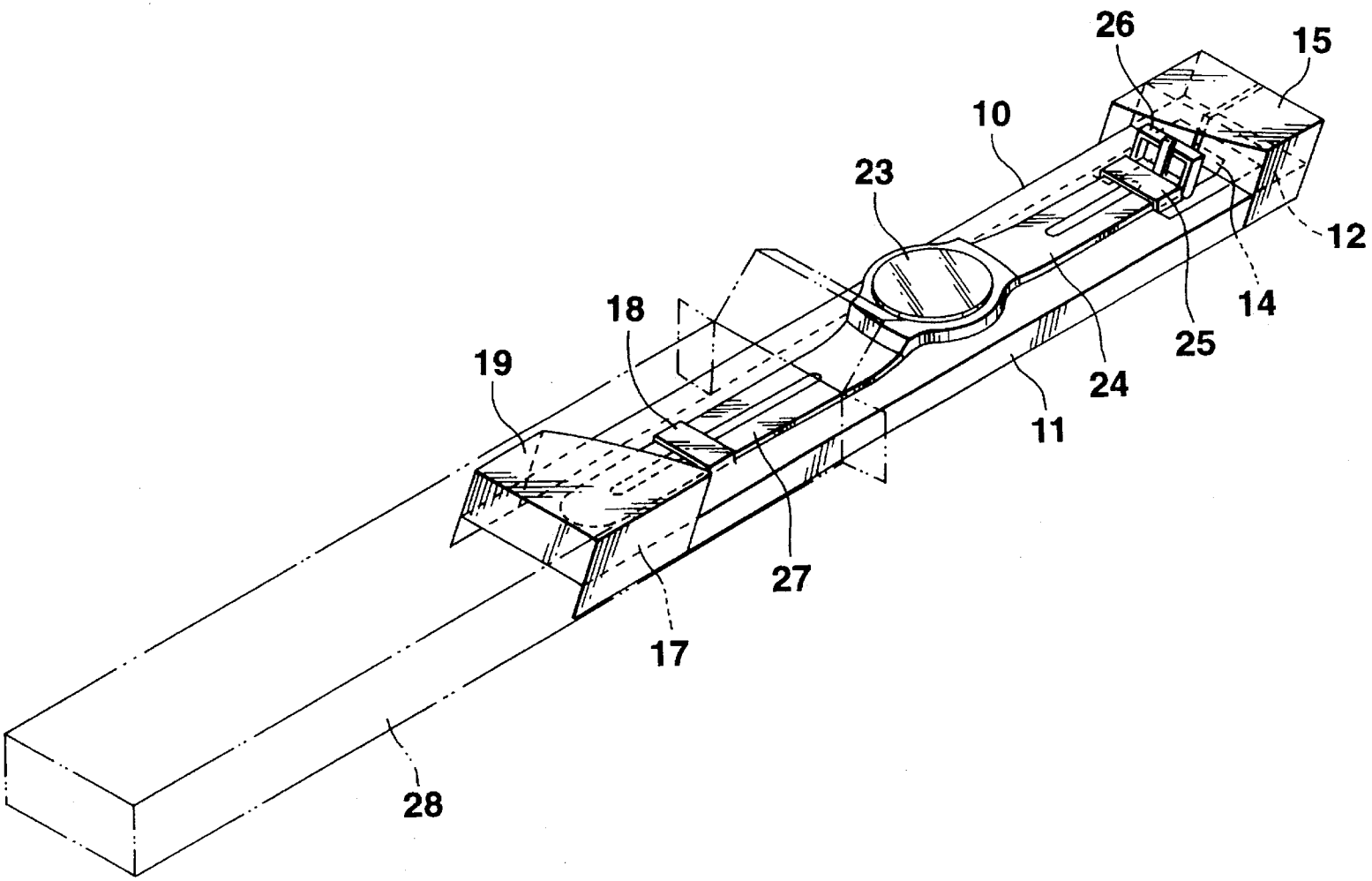
FIG. 1 is a perspective view showing a packaging structure according to a first embodiment of the present invention.

FIGS. 1 to 4 show a packaging structure according to a first embodiment of the present invention, which is used for packaging a wristwatch. Reference numeral 10 in these Figures designates a base.

Figure 2:
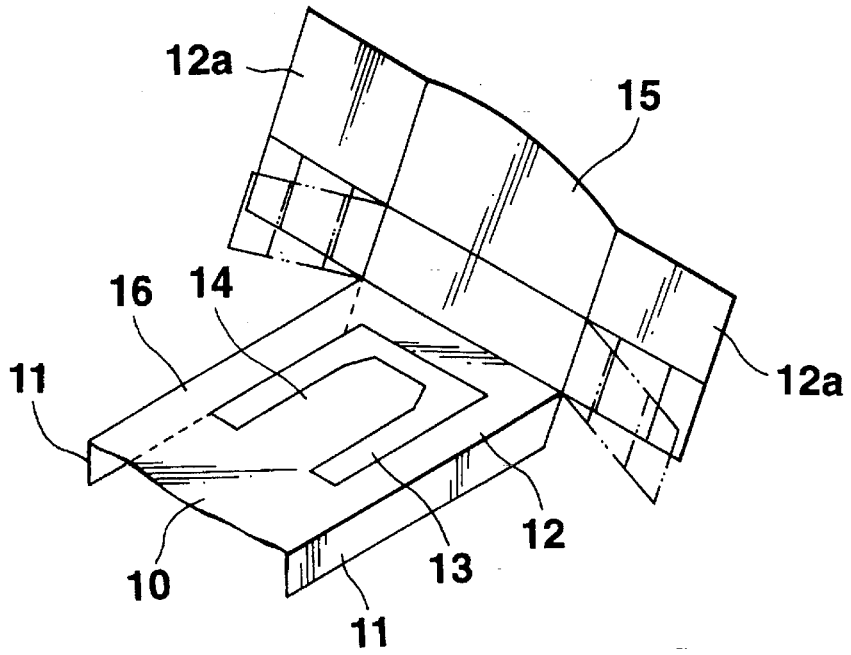
FIG. 2 is an enlarged, perspective view showing a main region of one end portion of a base in FIG. 1.

The base 10 is formed by blanking out of a substantially band-like cardboard and has at its longitudinally extending both side portions side walls 11, 11 bent downwardly with a predetermined width. As shown in FIG. 2, a U-shaped opening 13 is blanked out in one-end portion 12 of the base 10 to provide a tongue-like portion 14 extending toward an extending end of the one-end portion 12 in the longitudinal direction of the base 10. Further, a pillow portion 15 is formed in the one end portion 12 at a region located nearer to the extending end of the one-end portion 12 than the tongue-like portion 14. The pillow portion 15 has a box-like shape which covers the opening 13, and is constructed by making the region of the one end portion 12 at which the pillow portion 15 is formed being blanked out to be wider than the other of the one end portion 12, by bending the region upward and then bending it to be located above an upper surface 16 of the base 10, and by finally bending both side wings 12a toward the side walls 11 of the base 10.

Figure 3:
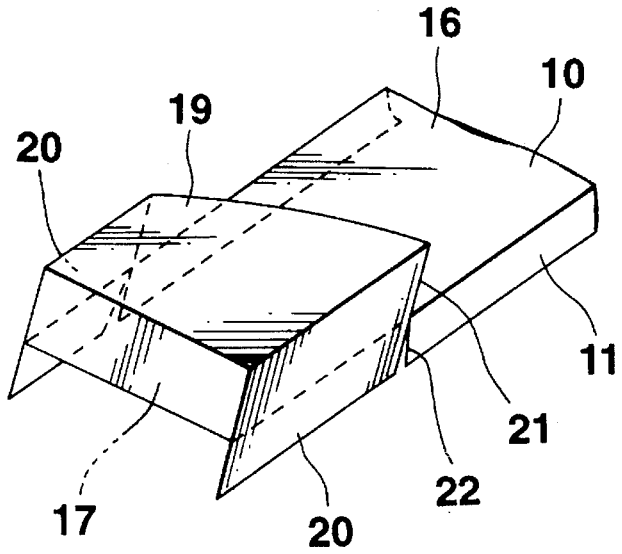
FIG. 3 is an enlarged, perspective view showing a main region of the other end portion of the base in FIG. 1.
Figure 4:
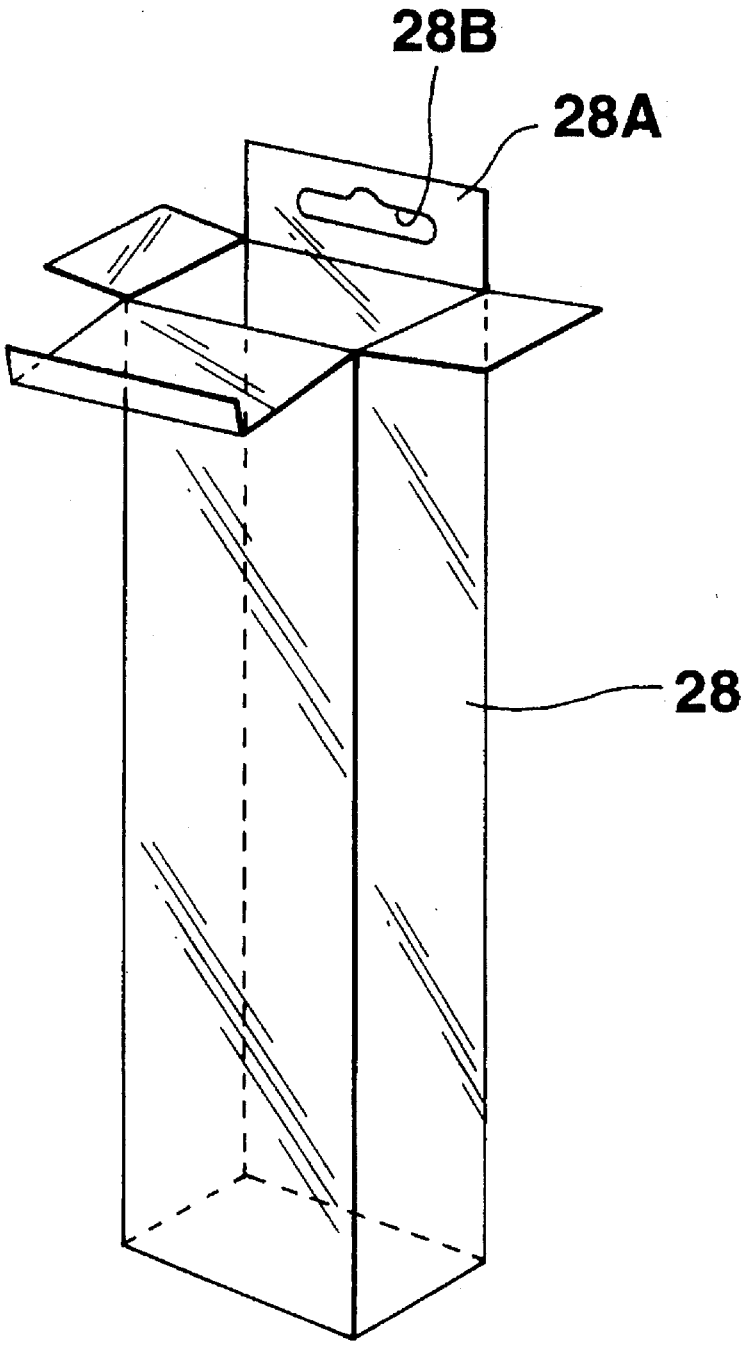
FIG. 4 is a perspective view showing a case into which the base in FIG. 1 is inserted.

Two slits are formed in the other end portion 17 of the base 10 at two positions separated from each other in a longitudinal direction of the base 10, and a band-like portion 18 extending in a width direction of the base 10 is produced between the two slits. A foot cover portion 19 is formed in the other end portion 17 of the base 10. As in the case of the pillow portion 15, the foot cover portion 19 is constructed by making an end region of the other end portion 17 being blanked out to be wider than the other of the other end portion 17, by bending the end region upward and then bending it to be located above the upper surface 16 of the base 10, and by finally bending both side wings 20 toward the side walls 11 of the base 10. As shown in FIG. 3, forward edges 21 of the both side wings 20 engage with rear edges 22 of the side walls 11 of the base 10.

A wristwatch (article) 23 is placed on the base 10 to insert the tongue-like portion 14 into an opening of a band keeper (circular member) 25 through a gap between the band keeper 25 and one watchband 24 on which the band keeper 25 is attached, to lay a buckle 26 of the watchband 24 on an inner side surface of the pillow portion 15 in an upwardly tilted state and to insert the other watchband 27 into the two slits with it being passed under the band-like portion 18. In this way, the wristwatch 23 is fixed on the base 10 such that an extending end of the tongue-like portion 14 is covered by the pillow portion 15. The base 10 on which the wristwatch 23 is so fixed as described above is inserted into a clear case 28 of a transparent synthetic resin shown in FIGS. 1 and 4, so that a packaging structure is provided. A hanged piece 28A extends from one end of the transparent case 23 which corresponds to the pillow portion 15 of base 10, and a through hole 28B is formed in the piece 28A. By inserting a peg-like hook member on a display corner of a store into the through hole 28B of the hanged piece 28A, the packing structure is displayed on the display corner.

According to the packaging structure of the first embodiment as described above in detail, since the wristwatch 23 is held on the base 10 by inserting the tongue-like portion 14 of the base 10 into the opening of the band keeper 25 through the gap between the band keeper (circular member) 25 and the one watchband 24, it is possible to use the base 10 for packaging wristwatches of various shapes and sizes. Since the tongue-like portion 14 of the base 10 prevents the one watchband 24 from displacing in right and left directions, it is also possible to prevent the wristwatch 23 from displacing in the right and left directions on the base 10 when vibration is applied to the packaging structure. Further, since the forward edges 21 of the side walls 20 of the foot cover portion 19 engage with the rear edges 22 of the side walls 11 of the base 10 so that, when the base 10 is inserted into the clear case 28, the base 10 can be smoothly inserted into the clear case 28 without the foot cover portion 19 being caught at an insertion opening of the clear case 28 to prevent the base 10 from inserting into the case 28. Since the extending end of the tongue-like portion 14 is covered by the pillow portion 15, any movement of the wristwatch 23 toward the extending end of the tongue-like portion 14 is restricted, thus preventing the wristwatch 23 from displacing out of the base 10.

Second Embodiment

Figure 5:
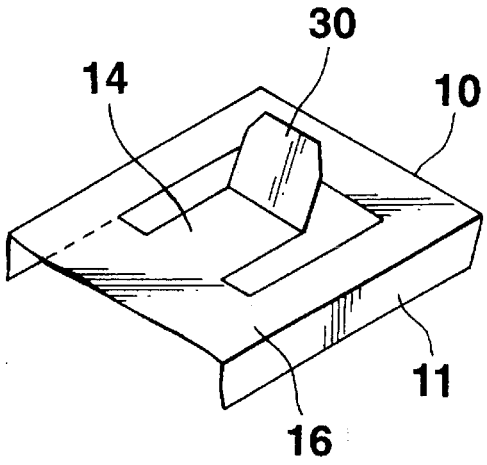
FIG. 5 is an enlarged, perspective view showing a main region of one end portion of a base in a packaging structure according to a second embodiment of the present invention.
Figure 6:
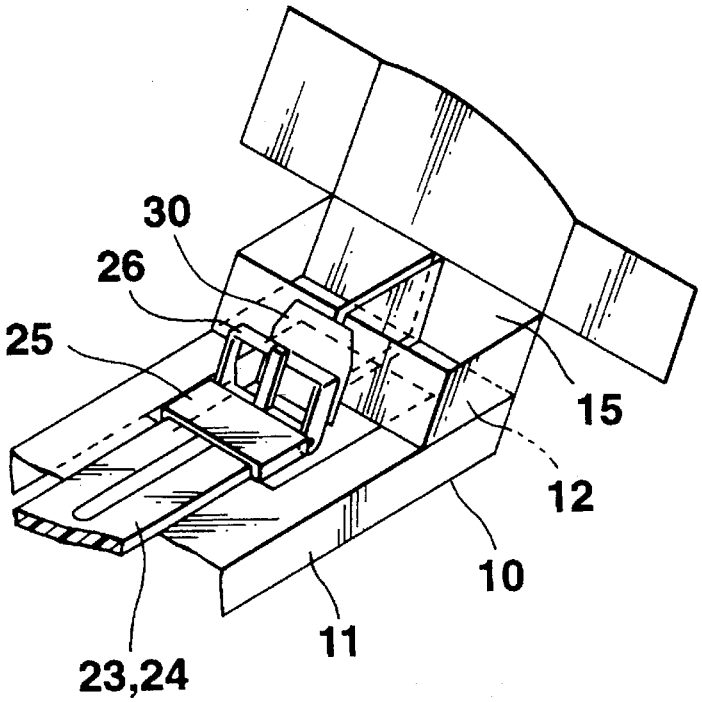
FIG. 6 is an enlarged, perspective view showing a main region of one end portion of a base according to a modification of the second embodiment of the present invention.

FIGS. 5 and 6 show a packaging structure according to a second embodiment of the present invention. The same structural elements as those in FIGS. 1 to 4 are designated by the same reference numerals as those used in FIGS. 1 to 4, and any further explanations of these structural elements are omitted. In a packaging structure as shown in FIGS. 5 and 6, the extending end of the tongue-like portion 14 is bent upward to provide an erected wall 30. As shown in FIG. 6, the buckle 26 of the one watchband 24 is laid on the erected wall 30 in a tilted state and the erected wall 30 is supported by the pillow portion 15. According to the packaging structure of this embodiment, it is possible to not only obtain the same advantages obtained by the first embodiment but also to prevent more positively the wristwatch 23 from displacing toward the extending end of the one end portion 12, and hence to fix more positively the wristwatch 23 on the base 10.

Third Embodiment

Figure 7:
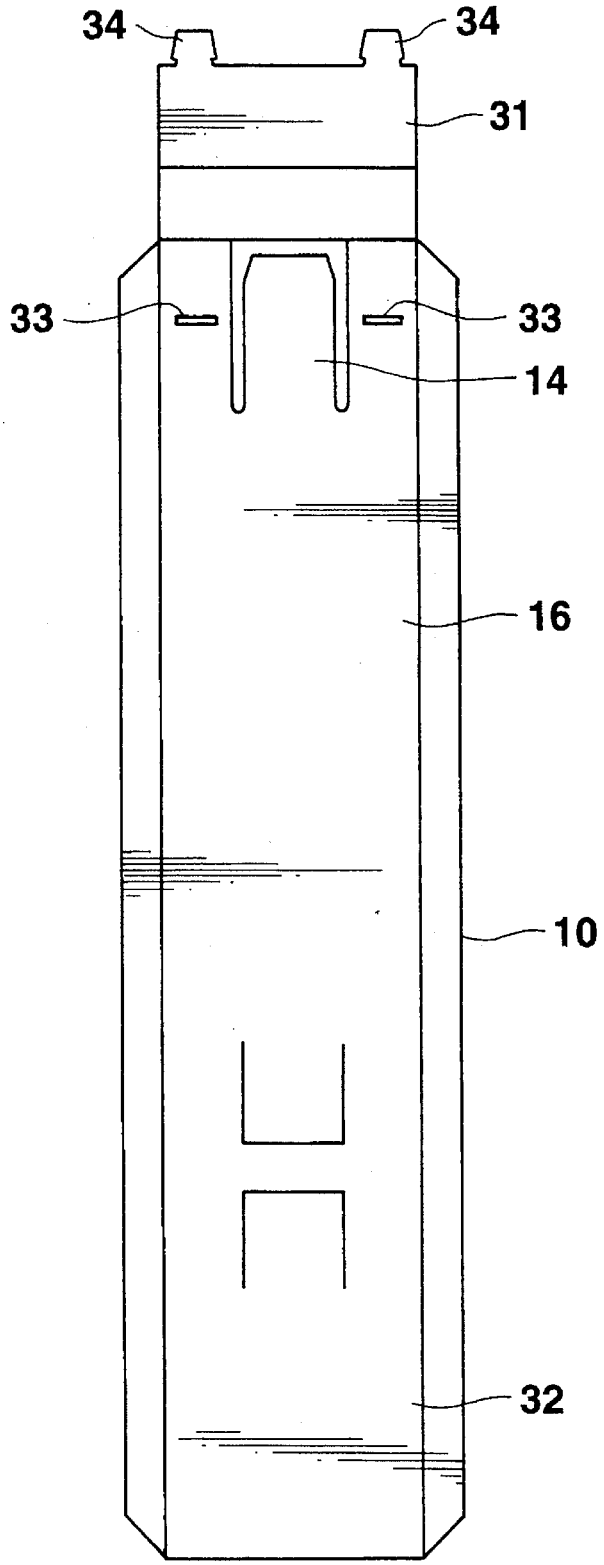
FIG. 7 is a front view showing a base of a packaging structure according to a third embodiment of the present invention.
Figure 8:
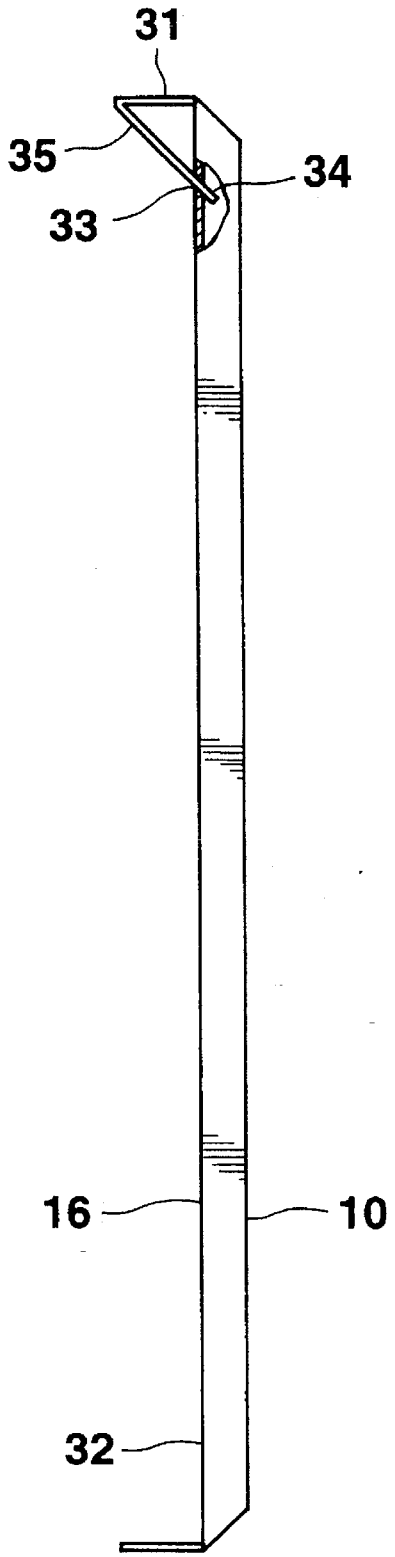
FIG. 8 is a side view showing the base of FIG. 7 in an assembled state.

FIGS. 7 and 8 show a packaging structure according to a third embodiment of the present invention. In the packaging structure, one end portion 31 of the base 10 is blanked out to have the same width as that of the upper surface 16 of the base 10. Two slits 33, 33 are formed in the base 10 at both right and left sides of the tongue-like portion 14 to extend in the width direction of the base 10. The one end portion 31 is bent upward and then bent toward the other end portion 32 of the base so as to be located above the upper surface 16 of the base 10. Further, a pair of projections 34, 34 formed in a tip edge of the one end portion 31 are inserted into the slits 33, 33, so that a pillow portion 35 having a triangular cross-section is provided on the base 10 as shown in FIG. 8.

According to the packaging structure of this embodiment, it is possible, as in the case of the above-mentioned second embodiment, to positively prevent the wristwatch 33 from displacing toward the one end portion 31 of the base 10. Further, since the pillow portion 35 is simpler in structure than that of the previous embodiments, thus making it possible to more readily make the packaging structure and hence to lower a material cost out of which the base 10 is blanked.

Fourth Embodiment

Figure 9:
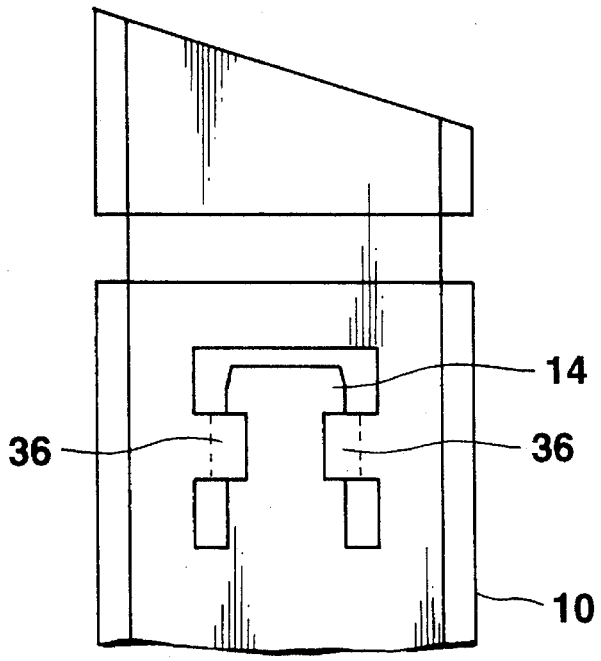
FIG. 9 is an enlarged, perspective view showing a main region of one end portion of a base in a packaging structure according to a fourth embodiment of the present invention.
Figure 10:
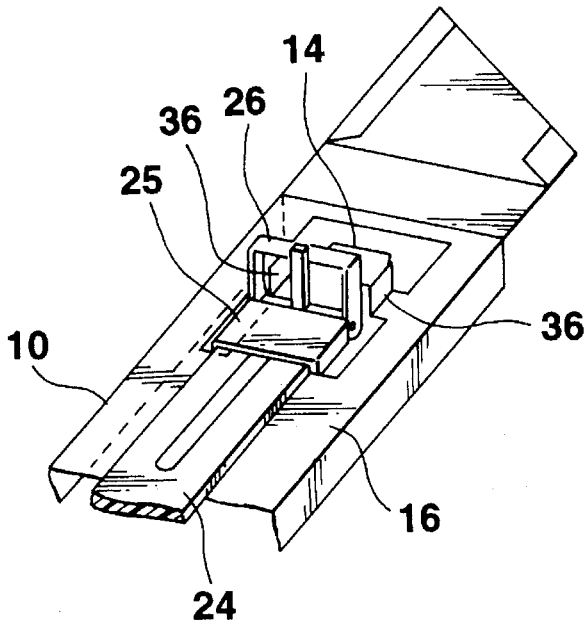
FIG. 10 is an enlarged, perspective view showing a main region of the other end portion the base in the packaging structure according to the fourth embodiment of the present invention.
Figure 11:
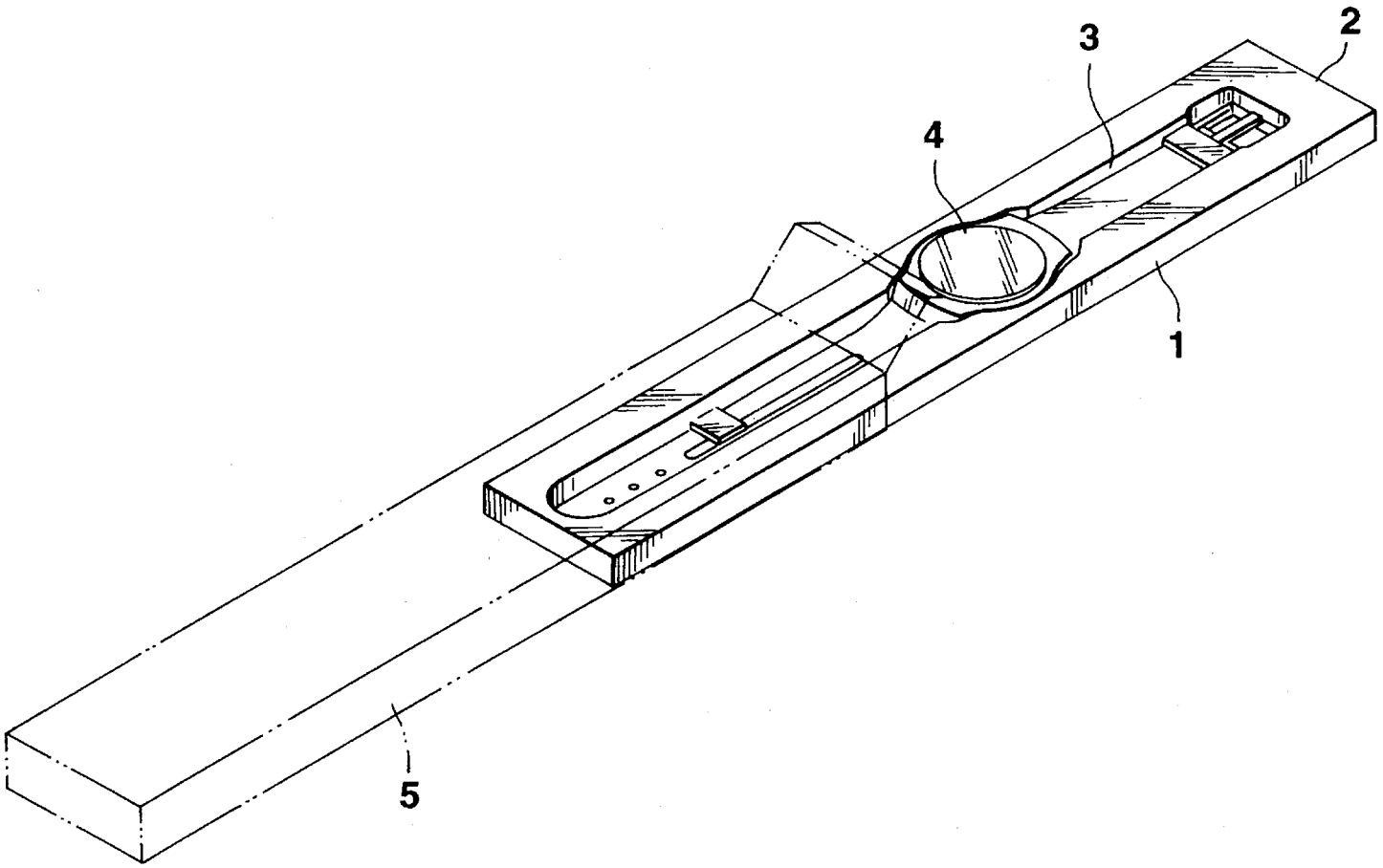
FIG.11 (PRIOR ART)
FIG. 11 is a perspective view showing a conventional packaging structure for a wristwatch.

FIGS. 9 and 10 show a packaging structure according to a fourth embodiment of the present invention. In the packaging structure shown in these Figures, a pair of small flaps 36, 36 are formed symmetrically to each other in the base 10 at both edges of an opening surrounding the tongue-like portion 14 so as to extend toward and over the both side edges of the tongue-like portion 14. After the tongue-like portion 14 is inserted into the opening of the band keeper (circular member) 25 through the gap between the band keeper (circular member) 25 and the one watchband 24, these flaps 36, 36 are bent upward in a substantially upright shape so that the flaps 36, 36 function as a pillow portion for supporting the buckle 26 in a tilted state.

According to the packaging structure of this embodiment, the base 10 can be used, as in the above described first to third embodiments, for those wristwatches of various shapes and sizes and prevent the wristwatch from displacing on the base 10. Further, the small flaps 36, 36 serve the same function as the pillow portions of the first and second embodiments, thus saving any additional pillow portion. This specific structure can ensure ready assemble and further the lower material cost for forming the base 10.

In the above described first to fourth embodiments, the packaging structure of the present invention has been explained as being applied to the packaging of the wristwatch, the present invention, however, is not restricted thereto. For example, the present invention can be applied equally to a packaging structure for packaging various articles or goods on transportation or on display.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A packaging structure for packaging an article having a circular member, said packaging structure comprising:

a plate-like base on which the article for packaging can be arranged for storage, said plate-like base including:

an opening formed in the plate-like base, a tongue-like portion extending into the opening, said tongue-like portion being insertable into the circular member of the article for packaging, a cover portion for covering an extending end portion of the tongue-like portion to prevent the circular member of the article for packaging into which the tongue-like portion is insertable from being removable therefrom, said cover portion being continuously formed from a portion of the plate-like base outside the opening thereof; and a case member for storing the plate-like base therein, said case member locking the cover portion of the plate-like base in place to cover the extending end portion of the tongue-like portion of the plate-like base and prevent the circular member of the article for packaging into which the tongue-like portion is insertable from being removable therefrom.

2. The packaging structure of claim 1, wherein said case member is transparent.

3. The packaging structure of claim 1, wherein said opening in the plate-like base comprises a U-shaped opening.

4. The packaging structure of claim 1, wherein said plate-like base includes two side edge portions which extend in parallel with both side ends of the tongue-like portion, said two side edge portions extending from the plate-like base in a direction opposite to the cover portion.

5. The packaging structure of claim 1, wherein said tongue-like portion insertable into the circular member of the article for packaging comprises a tongue-like member insertable into a band keeper of a watchband of a wristwatch.

6. The packaging structure of claim 1, further comprising a through hole formed in an end portion of the case member for enabling the case member to be hooked by a hook for display thereof.

7. The packaging structure of claim 6, wherein said through hole is formed in said end portion of the case member which is closer to the cover portion of the plate-like base stored in the case member than the other end portion of the case member.

8. A packaging structure for packaging an article having a circular member, said packaging structure comprising:

a plate-like base on which the article for packaging can be arranged for storage, said plate-like base including:

an opening formed in the plate-like base, a tongue-like portion extending into the opening and having an erectable portion at an extending end portion thereof, said tongue-like portion being insertable into the circular member of the article for packaging, a supporting portion for supporting the erectable portion of the tongue-like portion to keep the erectable portion erect and thereby prevent the circular member of the article for packaging into which the tongue-like portion is insertable from being removable therefrom, said supporting portion being continuously formed from a portion of the plate-like base outside the opening thereof; and a case member for storing the plate-like base therein, said case member locking the supporting portion of the plate-like base in place to support the erectable portion of the tongue-like portion of the plate-like base to keep the erectable portion erect and thereby prevent the circular member of the article for packaging into which the tongue-like portion is insertable from being removable therefrom.

9. The packaging structure of claim 8, wherein said case member is transparent.

10. The packaging structure of claim 8, wherein said opening in the plate-like base comprises a U-shaped opening.

11. The packaging structure of claim 8, wherein said plate-like base includes two side edge portions which extend in parallel with both side ends of the tongue-like portion, said two side edge portions extending from the plate-like base in a direction opposite to the supporting portion.

12. The packaging structure of claim 8, wherein said tongue-like portion insertable into the circular member of the article for packaging comprises a tongue-like member insertable into a band keeper of a watchband of a wristwatch.

13. The packaging structure of claim 8, further comprising a through hole formed in an end portion of the case member for enabling the case member to be hooked by a hook for display thereof.

14. The packaging structure of claim 13, wherein said through hole is formed in said end portion of the case member which is closer to the supporting portion of the plate-like base stored by the case member than the other portion of the case member.

* * * * *